United States Patent [19]

Levin

[11] Patent Number: 4,934,268

[45] Date of Patent: Jun. 19, 1990

[54] WARHEAD INITIATION CIRCUIT

[75] Inventor: Don M. Levin, Baltimore, Md.

[73] Assignee: The United States of America as represented by the Secretary of the Army, Washington, D.C.

[21] Appl. No.: 305,337

[22] Filed: Jan. 26, 1989

[51] Int. Cl.[5] ..... F42C 11/06

[52] U.S. Cl. ..... 102/220; 102/216

[58] Field of Search ..... 102/218, 220, 216, 206

[56] References Cited

U.S. PATENT DOCUMENTS

| | | | |
|---|---|---|---|
| 3,141,114 | 7/1964 | Jenkins et al. . | |
| 3,504,632 | 4/1970 | West et al. . | |
| 3,598,056 | 8/1971 | West et al. . | |
| 3,604,356 | 9/1971 | Browning . | |
| 3,672,303 | 6/1972 | Brawn . | |
| 3,853,066 | 12/1974 | Campagnuolo et al. . | |
| 4,296,688 | 10/1981 | Orlandi | 102/218 |

FOREIGN PATENT DOCUMENTS

| | | | |
|---|---|---|---|
| 265082 | 9/1968 | Austria | 102/220 |
| 521095 | 3/1931 | Fed. Rep. of Germany | 102/206 |
| 54-43454 | 4/1979 | Japan | 102/220 |

*Primary Examiner*—Deborah L. Kyle
*Assistant Examiner*—Stephen Johnson
*Attorney, Agent, or Firm*—Saul Elbaum; W. Robert Baylor; Muzio B. Roberto

[57] ABSTRACT

A controlled rectifier firing circuit for the warhead of a missile located on a rocket powered test sled traveling along a track in a target vulnerability test range. The firing circuit includes a silicon controlled rectifier which when rendered conductive discharges a capacitor to fire a warhead detonator. A relatively high voltage DC source is coupled to the capacitor prior to sled travel toward the target. A second capacitor is also charged from the high voltage source and discharges through a resistance when an impact type actuator switch is closed at the time of detonation. The voltage developed across the resistor is coupled to the gate electrode of the silicon controlled rectifier which renders it conductive, causing the first capacitor to discharge through the detonator to fire the warhead.

5 Claims, 1 Drawing Sheet

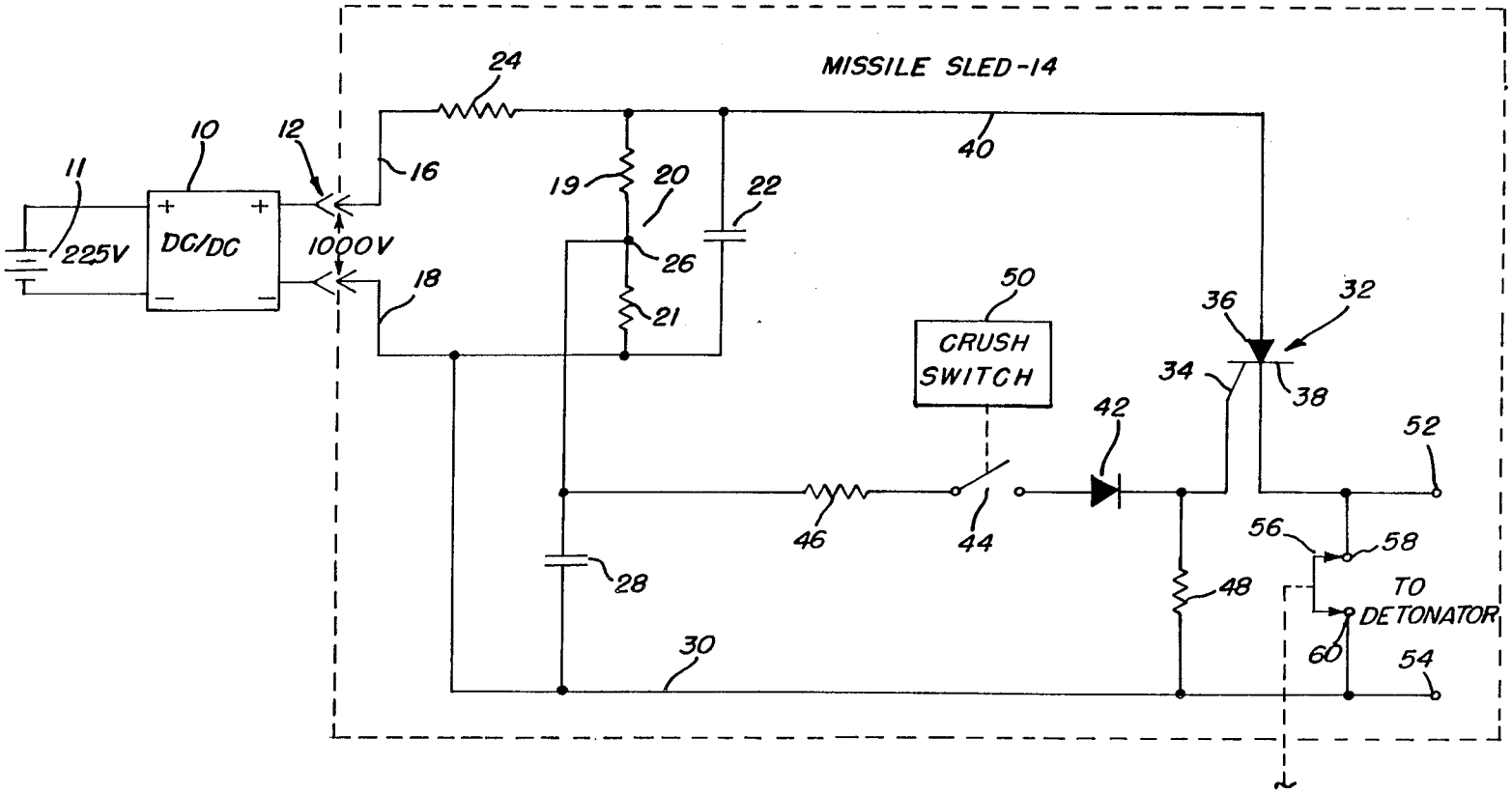
MISSILE SLED-14
CRUSH SWITCH
TO DETONATOR
DC/DC
225V
1000V
10
11
12
16
18
19
20
21
22
24
26
28
30
32
34
36
38
40
42
44
46
48
50
52
54
56
58
60

WARHEAD INITIATION CIRCUIT

BACKGROUND OF THE INVENTION

1. Field of the Invention

This invention relates generally to a firing circuit for triggering a detonator and more particularly to a firing circuit for energizing the detonator which triggers the explosive train in a piece of ordnance.

2. Background of the Invention

Involved in the testing of target vulnerability to attack, missiles such as anti-tank missiles are placed on a rocket powered sled and launched toward the target.

Live fire vulnerability tests measure a target's vulnerability to attack and require precise target impacts, far better than that which could be achieved by a missile traveling in air, for example, 3000 meters. Typically, a test bed for conducting live fire vulnerability tests includes a length of track, for example 100 feet or more in length, on which is placed a sled. Rocket motors are placed on the sled and used to propel the sled and missile down the track to impact with the target. Associated with each of the missiles is a device known as a safe and arming (S&A) device which contains a small detonator for firing the warhead.

Warhead penetration is a function of the standoff of the warhead from the target. As this distance decreases, the penetration decreases. A typical missile used in a live fire vulnerability test bed has an 18 inch probe that sticks out in front of the warhead to increase the standoff distance. A detonator that functions in greater than 20 microseconds will defeat the standoff and degrade penetration. Safe detonators such as blasting caps, have been found to be undesirable because they function in 1000 to 10,000 microseconds which defeats the standoff and degrades penetration. If, for instance the missile were traveling on the track at 700 ft/sec. and a blasting cap took one millisecond to function, the standoff would be degraded by 8.40 inches, which is completely unacceptable. Detonators that typically function in less than 20 microseconds have been found to be extremely dangerous since they are highly susceptible to static electricity.

In the past, the detonators were placed on the sled and were oriented 90° out of line with the warhead and subsequently rotated into alignment after the missile is launched toward the target. A high failure rate resulted. A more reliable method of firing the missile resulted when the detonator was placed permanently against the warhead in a special housing; however, this method also proved to be extremely dangerous to personnel working in the immediate vicinity.

Recently a detonator has been found that is relatively safe to handle. It comprises an exploding bridge wire (EBW) detonator, Model RP80 manufactured by Reynolds Industries, Inc. of San Ramone, California. Because of the relatively high energy required to fire this type of detonator, the RB80 EBW needed to be fired with a relatively complicated and expensive firing set.

Accordingly, it is an object of the present invention to provide an improvement in warhead initiation circuits.

It is another object of the invention to provide a relatively simple yet efficient firing circuit for triggering the detonator of a missile warhead.

It is still a further object of the invention to provide a warhead initiation circuit for actuating the detonator of a missile warhead during a target vulnerability test.

SUMMARY

Briefly, the foregoing and other objects are achieved by a controlled rectifier firing circuit located on a test sled utilized in target vulnerability test equipment and having a silicon controlled rectifier which when rendered conductive discharges a capacitor to fire a detonator for a missile warhead. A relatively high voltage DC source is coupled to the capacitor prior to activation. A second capacitor is charged from the high voltage source and discharges through a resistance when an actuator switch is closed when detonation is desired. The voltage developed across the resistor is coupled to the gate electrode of the silicon controlled rectifier which renders it conductive, causing the first capacitor to discharge through the detonator, causing the warhead to fire.

BRIEF DESCRIPTION OF THE DRAWINGS

A better understanding of the invention will be obtained when the following detailed description of the invention is considered in connection with the accompanying drawing in which:

the figure comprises an electrical schematic diagram illustrative of the preferred embodiment of the invention.

DETAILED DESCRIPTION OF THE INVENTION

Referring now to the drawing, reference numeral 10 denotes a DC-to-DC converter coupled to a relatively low voltage (22.5 volt) DC battery 11 and is operable to produce an output of at least 1000 volts DC. The relatively high voltage output of the converter 10 is coupled to a cable-connector assembly 12 which attaches to a rocket powered sled 14 carrying an RP80 detonator, not shown, for a missile, also not shown, utilized in a live fire vulnerability test bed.

The circuitry shown located on the missile sled 14 comprises a warhead initiation circuit for firing the detonator and is shown comprising a pair of DC input terminal leads 16 and 18 for receiving a high voltage DC output from the converter 10 via the cable-connector assembly 12. A resistance voltage divider network 20 comprised of series connected resistances 19 and 21 and a fixed capacitor 22 are coupled across the circuit leads 16 and 18 through a fixed resistor 24. The circuit node 26 of the voltage divider network 20 is coupled to one side of another fixed capacitor 28 whose other side is connected to a common return circuit lead 30 connected to the input lead 18.

A controlled rectifier 32 comprising a silicon controlled rectifier (SCR) having a gate electrode 34, an anode electrode 36 and a cathode electrode 38 is coupled to one side of the capacitor 22 by means of its anode electrode 36 and a circuit lead 40. The gate electrode 34 is coupled across the capacitor 28 by means of a diode 42, an electrical switch device 44, and a fixed resistance 46 and a fixed resistor 48, the latter being connected directly from the gate electrode 34 to the circuit lead 30.

The switch element 44 comprises a switch which can be physically actuated, for example, by a special crush switch member 50, also located on the sled 14 which activates upon impact with the target.

The cathode electrode 38 of the silicon controlled rectifier 32 is connected to one terminal 52 of a pair of output terminals 52 and 54 connected across the warhead detonator, not shown. A shorting pin 56 is also shown coupled across terminals 58 and 60 connected across the output terminals 52 and 54 for a purpose which will be subsequently explained.

The circuit components shown in the drawing are typically placed in a small metal box, not shown, so that the shorting pin 56 is connected to the terminals 58 and 60 from outside the box via the terminals 58 and 60. The box is filled with a foam type of material so that it acts as a shock absorber to protect the components during movement of the sled 14 along the test track.

In operation, the capacitor 22 is charged to the full output voltage of the DC-to-DC converter 10. The capacitor 28 is charged to a lesser voltage corresponding to the voltage appearing at circuit node 26 of the voltage divider 20. When the missile sled 14 is started down the track, it disconnects from the cable-connector assembly 12. At the same time the shorting pin 56 is also pulled from terminals 58 and 60 and the missile sled continues toward the target. When the sled hits the target, the crush switch actuator 50 closes the switch element 44, causing capacitor 28 to discharge through resistors 46 and 48. The voltage thus generated across resistor 48 acts to trigger the silicon controlled rectifier 32 rendering the SCR conductive. This in turn causes the capacitor 22 to discharge through the anode and cathode electrodes 36 and 38 and the detonator, not shown, whereupon the explosive train in the warhead is initiated.

A relatively simple yet reliable circuit is thus provided for firing a relatively fast acting detonator utilized to initiate the firing of the warhead of a missile located on a sled utilized in connection with a live fire vulnerability test bed.

Having thus shown and described what is at present considered to be the Preferred embodiment of the invention, it should be noted that the same has been made by way of illustration and not limitation. Accordingly, all alterations, modifications and changes coming within the spirit and scope of the invention are herein meant to be included.

I claim:

1. An initiation circuit for an explosive detonation, comprising:

a pair of input terminals coupled to a DC power source;

a pair of output terminals coupled to said detonator;

a controlled rectifier having a pair of power electrodes and a control electrode;

first electrical capacitor means coupled to said input terminals and being chargeable from said DC power source and being coupled across one of said pair of power electrodes of said controlled rectifier and one of said pair of output terminals for firing said detonator when discharge;

selectively operable switch means for initiating detonation of the explosive detonator;

second electrical capacitor means coupled to said input terminals and being chargeable from said DC power source and being coupled to said switch means across said control electrode of said controlled rectifier and said one output terminal for rendering said controlled rectifier conductive when discharged by operation of said switch means;

an electrical resistor means coupled between said control electrode of said controlled rectifier and said one output terminal of said detonator for generating a controlled rectifier trigger voltage thereacross upon discharge of said second electrical capacitor means;

and a diode coupled between said resistor means and said second capacitor means, whereby conduction of said controlled rectifier upon actuation of said switch means provides a current discharge path for said first capacitor means through said detonator causing the detonator to fire.

2. The initiation circuit as defined by claim 1 wherein said controlled rectifier comprises a semiconductor controlled rectifier.

3. The initiation circuit as defined by claim 1 and additionally including means coupled to said switch means for operating said switch means.

4. The initiation circuit as defined by claim 3 and additionally including a removable mounted shorting pin across said pair of output terminals.

5. The initiation circuit as defined by claim 3 and additionally including means for coupling said DC power source to said pair of input terminals and being disengageable therefrom.

* * * * *